US010424259B2

(12) United States Patent
Long et al.

(10) Patent No.: US 10,424,259 B2
(45) Date of Patent: Sep. 24, 2019

(54) DEMULTIPLEXER CIRCUIT, SIGNAL LINE CIRCUIT AND CORRESPONDING OUTPUT CIRCUIT AND DISPLAY DEVICE

(71) Applicant: BOE TECHNOLOGY GROUP CO., LTD., Beijing (CN)

(72) Inventors: Chunping Long, Beijing (CN); Yong Qiao, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 94 days.

(21) Appl. No.: 15/526,441

(22) PCT Filed: May 6, 2016

(86) PCT No.: PCT/CN2016/081285
§ 371 (c)(1),
(2) Date: May 12, 2017

(87) PCT Pub. No.: WO2017/133109
PCT Pub. Date: Aug. 10, 2017

(65) Prior Publication Data

US 2018/0061339 A1 Mar. 1, 2018

(30) Foreign Application Priority Data

Feb. 6, 2016 (CN) ..... 2016 2 0120890 U

(51) Int. Cl.
*G09G 3/36* (2006.01)
*G09G 3/20* (2006.01)

(52) U.S. Cl.
CPC ..... *G09G 3/3648* (2013.01); *G09G 3/2096* (2013.01); *G09G 3/3614* (2013.01);
(Continued)

(58) Field of Classification Search
CPC combination set(s) only.
See application file for complete search history.

(56) References Cited

U.S. PATENT DOCUMENTS

2003/0090451 A1* 5/2003 Ahn ..... G09G 3/3688 345/96
2004/0104873 A1 6/2004 Kang et al.
(Continued)

FOREIGN PATENT DOCUMENTS

CN 1417771 A 5/2003
CN 104700796 A 6/2015
CN 104956427 A 9/2015

OTHER PUBLICATIONS

English translation of PCT International Search Report, Application No. PCT/CN2016/081285, dated Nov. 11, 2016, 2 pages.
(Continued)

*Primary Examiner* — Temesghen Ghebretinsae
*Assistant Examiner* — Sosina Abebe
(74) *Attorney, Agent, or Firm* — Armstrong Teasdale LLP

(57) ABSTRACT

Exemplary embodiments of the present disclosure provide a demultiplexer circuit, a signal line circuit and a corresponding output circuit, and a display. The demultiplexer circuit includes at least one first input terminal configured to receive a first signal, at least one second input terminal configured to receive a second signal, at least one first output terminal configured to output the first signal and the second signal, and at least one second output terminal configured to output the first signal and the second signal. The demultiplexer circuit according to exemplary embodiments of the present disclosure can reduce the signal input lines and the input ports, further facilitate to reduce the layout space of wiring.

17 Claims, 3 Drawing Sheets

(52) U.S. Cl.
CPC ..... *G09G 3/3685* (2013.01); *G09G 3/3688* (2013.01); *G09G 2300/0426* (2013.01); *G09G 2310/0297* (2013.01)

(56) References Cited

U.S. PATENT DOCUMENTS

| | | | | |
|---|---|---|---|---|
| 2008/0170027 | A1 | 7/2008 | Kyeong et al. | |
| 2015/0279896 | A1* | 10/2015 | Kurokawa | G02F 1/1362 257/43 |
| 2015/0356940 | A1* | 12/2015 | Yamaguchi | G09G 3/3688 345/92 |
| 2016/0134278 | A1* | 5/2016 | Zhou | H03K 17/687 327/427 |

OTHER PUBLICATIONS

PCT Written Opinion, Application No. PCT/CN2016/081285, dated Nov. 11, 2016, 7 pages.: with English translation of relevant part.

* cited by examiner

DEMULTIPLEXER CIRCUIT, SIGNAL LINE CIRCUIT AND CORRESPONDING OUTPUT CIRCUIT AND DISPLAY DEVICE

CROSS REFERENCE TO RELATED APPLICATIONS

This application is a National Stage Entry of PCT/CN2016/081285 filed on May 6, 2016, which claims the benefit and priority of Chinese Patent Application No. 201620120890.4, filed on Feb. 6, 2016, the disclosures of which are incorporated by reference herein in their entirety as part of the present application.

BACKGROUND

Exemplary embodiments of the present disclosure relate to a demultiplexer circuit, a signal line circuit and a corresponding output circuit, and a display device.

This section is intended to introduce to the reader the techniques of various aspects of the art that may be relevant to the various aspects of the application, and it is believed that this section will help to provide background information to the reader in order for better understanding of the various aspects of the application. It should be understood, therefore, this section should be interpreted from this perspective, rather than as a recognition of the prior art.

In the structural design of a Thin Film Transistor Liquid Crystal Display device (TFT LCD), peripheral circuits of the array substrate includes an electrostatic discharge circuit, gate scan lines, data lines, common electrode lines, repair lines and test lines, and the layout space is limited. For example, more data lines in a high-resolution display panel require more output pins of data drive integrated circuits (ICs). The current drive integrated circuit (IC) technology can hardly meet the requirements of the high-resolution panel.

BRIEF DESCRIPTION

The demultiplexer circuit, the signal line circuit and the corresponding output circuit, and the display device according to the exemplary embodiments of the present disclosure facilitate to reduce signal input lines and input ports, thus further facilitate to reduce the layout space for wiring.

A first aspect of the present disclosure provides a demultiplexer circuit including at least one first input terminal configured to receive a first signal, at least one second input terminal configured to receive a second signal, at least one first output terminal configured to output the first signal and the second signal, and at least one second output terminal configured to output the first signal and the second signal.

According to an embodiment of the present disclosure, the demultiplexer circuit further includes at least one selection switch group. The selection switch group at least includes a first selection switch subgroup and a second selection switch subgroup, wherein at least one terminal of the first selection switch subgroup is coupled to the first input terminal, and at least one terminal of the second selection switch subgroup is coupled to the second input terminal.

According to an embodiment of the present disclosure, the demultiplexer circuit further includes at least one selection switch group, the selection switch group at least including a first selection switch subgroup and a second selection switch subgroup, wherein at least one terminal of the first selection switch subgroup is coupled to the first input terminal, at least one terminal of the first selection switch subgroup is coupled to the second input terminal, and at least one terminal of the second selection switch subgroup is coupled to the first input terminal and at least one terminal of the second selection switch subgroup is coupled to the second input terminal.

According to an embodiment of the present disclosure, at least one terminal of the first selection switch subgroup is coupled to the first output terminal and at least one terminal of the second selection switch subgroup is coupled to the second output terminal.

According to an embodiment of the present disclosure, at least one terminal of the first selection switch subgroup is coupled to the first output terminal and at least one terminal of the first selection switch subgroup is coupled to the second output terminal, and at least one terminal of the second selection switch subgroup is coupled to the first output terminal and at least one terminal of the second selection switch subgroup is coupled to the second output terminal.

According to an embodiment of the present disclosure, the demultiplexer circuit further includes a signal selection group including a plurality of output terminals, at least one output terminal of the signal selection group is coupled to the first selection switch subgroup, at least one output terminal of the signal selection group is coupled to the second selection switch subgroup.

According to an embodiment of the present disclosure, the first selection switch subgroup and the second selection switch subgroup each include at least two selection transistors, the gate electrode of the selection transistor is coupled to at least one output terminal of the signal selection group.

According to an embodiment of the present disclosure, the signal selection group includes k signal selection lines corresponding to k output terminals of the signal selection group, the gate electrodes of at least two adjacent selection transistors in the first selection switch subgroup or the second selection switch subgroup are commonly coupled to one of the k signal selection lines, or the gate electrodes of the selection transistors in the first selection switch subgroup or the second selection switch subgroup are respectively coupled to the signal selection lines one-to-one, wherein k is a natural number greater than or equal to two.

According to an embodiment of the present disclosure, the signal selection group includes k signal selection lines corresponding to k output terminals of the signal selection group. The first selection switch subgroup includes k selection transistors. The second selection switch subgroup includes n selection transistors. Second electrodes of at least a part of the selection transistors in the first selection switch subgroup are coupled to at least one of the first input terminal or the second input terminal. Second electrodes of at least a part of the selection transistors in the second selection switch subgroup are coupled to at least one of the first input terminal or the second input terminal, wherein k and n are natural numbers greater than or equal to two.

According to an embodiment of the disclosure, first electrodes of at least a part of the selection transistors in the first selection switch subgroup are coupled to the second output terminal. First electrodes of at least a part of the selection transistors in the second selection switch subgroup are coupled to the first output terminal. Gate electrodes of the selection transistors in the first selection switch subgroup are respectively coupled to the corresponding signal selection lines. Gate electrodes of the selection transistors in the second selection switch subgroup are respectively coupled to the corresponding signal selection lines.

According to an embodiment of the present disclosure, second electrodes of a part of the selection transistors in the first selection switch subgroup are coupled to the first input terminal. Second electrodes of a part of the selection transistors in the first selection switch subgroup are coupled to the second input terminal. Second electrodes of a part of the selection transistors in the second selection switch subgroup are coupled to the first input terminal. Second electrodes of a part of the selection transistors in the second selection switch subgroup are coupled to the second input terminal.

According to an embodiment of the present disclosure, the first output terminal includes k output ports, the second output terminal includes n output ports. First electrodes of the k selection transistors in the first selection switch subgroup are coupled to the k output ports of the first output terminal one-to-one. First electrodes of the n selection transistors in the second selection switch subgroup are coupled to the n output ports of the second output terminal one-to-one. Second electrodes of the selection transistors in the selection switch group are alternately coupled to the first input terminal and the second input terminal, and the gate electrodes of the selection transistors in the first selection switch subgroup and the second selection switch subgroup are respectively coupled to different signal selection lines one-to-one, wherein k and n are odd numbers.

According to an embodiment of the present disclosure, the first output terminal includes k output ports, the second output terminal includes n output ports. First electrodes of the k selection transistors in the first selection switch subgroup are coupled to the k output ports of the first output terminal one-to-one. First electrodes of the n selection transistors in the second selection switch subgroup are coupled to the n output ports of the second output terminal one-to-one. Second electrodes of the selection transistors in the first selection switch subgroup are alternately coupled to the first input terminal and the second input terminal. Second electrodes of the selection transistors in the second selection switch subgroup are alternately coupled to the first input terminal and the second input terminal. Gate electrodes of at least two adjacent selection transistors in the first selection switch subgroup or the second selection switch subgroup are commonly coupled to one of the k signal selection lines, wherein k and n are even numbers.

According to an embodiment of the present disclosure, the first output terminal includes k output ports, the second output terminal includes n output ports. First electrode of at least one selection transistor in the first selection switch subgroup is coupled to one output port of the second output terminal. First electrode of at least one selection transistor in the second selection switch subgroup is coupled to one output port of the first output terminal.

According to an embodiment of the present disclosure, the selection transistor is an NMOS field effect transistor, the first electrode of the selection transistor is the drain electrode of the NMOS field effect transistor, the second electrode of the selection transistor is the source electrode of the NMOS field effect transistor, or the selection transistor is a PMOS field effect transistor, the first electrode of the selection transistor is the source electrode of the PMOS field effect transistor, the second electrode of the selection transistor is the drain electrode of the PMOS field effect transistor.

According to an embodiment of the present disclosure, the first signal and the second signal are data signals, gate scan signals, or common voltage signals.

According to an embodiment of the present disclosure, the voltages of the first signal and the second signal are opposite in polarity.

A second aspect of the present disclosure provides a signal line circuit, including a demultiplexer circuit, a first signal line group configured to receive a first signal and a second signal from the demultiplexer circuit, and a second signal line group configured to receive the first signal and the second signal from the demultiplexer circuit.

According to an embodiment of the present disclosure, the demultiplexer circuit includes at least one first input terminal configured to receive a first signal, at least one second input terminal configured to receive a second signal, at least one first output terminal configured to output the first signal and the second signal, and at least one second output terminal configured to output the first signal and the second signal, wherein the first signal line group is coupled to the first output terminal, and the second signal line group is coupled to the second output terminal.

A third aspect of the present disclosure provides an output circuit including a demultiplexer circuit, a first signal line group, a second signal line group, a first signal line, and a second signal line, wherein the demultiplexer circuit is coupled to the first signal line and the second signal line, outputs a first signal from the first signal line and a second signal from the second signal line to the first signal line group, and outputs the first signal from the first signal line and the second signal from the second signal line to the second signal line group.

According to an embodiment of the present disclosure, the demultiplexer circuit includes at least one first input terminal configured to receive the first signal, at least one second input terminal configured to receive the second signal, at least one first output terminal configured to output the first signal and the second signal, and at least one second output terminal configured to output the first signal and the second signal, wherein the first signal line group is coupled to the first output terminal and the second signal line group is coupled to the second output terminal.

A fourth aspect of the present disclosure provides a display device including the demultiplexer circuit of any one of the above.

A fifth aspect of the present disclosure provides a display device including the signal line circuit of any one of the above.

A sixth aspect of the present disclosure provides a display device including the output circuit of any one of the above.

BRIEF DESCRIPTION OF THE DRAWINGS

In order to more clearly illustrate the technical solutions in the embodiments of the present disclosure, the drawings to be used in the description of the embodiments will be briefly described below. Apparently, the drawings in the following description merely involve some embodiments of the present disclosure, and those of ordinary skill in the art also may obtain other drawings based on these drawings without the need for creative work.

DETAILED DESCRIPTION

Figure 1:
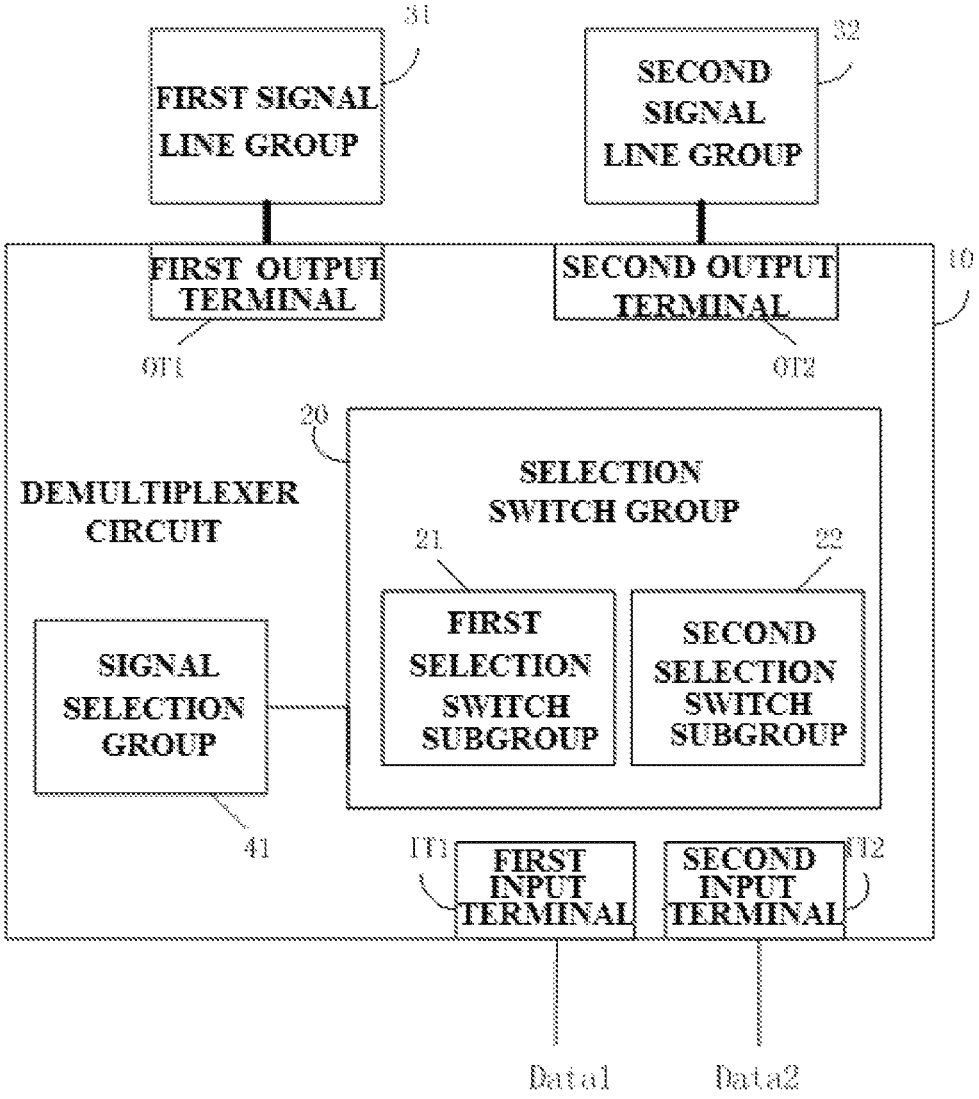
FIG. 1 is a schematic structural view of an output circuit according to an exemplary embodiment of the present disclosure.

To make the technical solutions and advantages of embodiments of the present disclosure more clear, the technical solutions in the embodiments of the present disclosure will be clearly and completely described below in conjunction with the drawings in the embodiments of the present disclosure. Obviously, the embodiments described merely are part of embodiments of the present disclosure, instead of all the embodiments. Based on the embodiments of the present disclosure, all other embodiments obtained by those of ordinary skill in the art without creative work fall within the scope of protection sought for by the present disclosure.

In the description of the present disclosure, it should be noted that the orientational or positional relationships indicated by the terms "up", "low", "top", "bottom" and the like are based on the orientational or positional relationships shown in the drawings. They are intended to facilitate and simplify the description of the present disclosure, rather than indicate or imply that the means or elements referred to must have a particular orientation, or constructed and operated in a particular orientation. Thus, they are not to be construed as limiting the present disclosure.

In addition, in the description of the present disclosure, unless otherwise indicated, "a plurality of" means two or more. Unless otherwise indicated, "couple" may indicate a direct or indirect electrical connection.

As shown in FIG. 1, a demultiplexer circuit 10 according to an embodiment of the present disclosure may include at least one first input terminal IT1 receiving a first signal, at least one second input terminal IT2 receiving a second signal, at least one first output terminal OT1 outputting the first signal and the second signal, and at least one second output terminal OT2 outputting the first signal and the second signal.

The signal line circuit according to an embodiment of the present disclosure may include a demultiplexer circuit 10, a first signal line group 31, and a second signal line group 32. The demultiplexer circuit 10 outputs the first signal and the second signal through the first output terminal OT1 and the second output terminal OT2, the first signal line group 31 receives the first signal and the second signal from the demultiplexer circuit 10, and the second signal line group 32 receives the first signal and the second signal from the demultiplexer circuit 10.

Although in the embodiment shown in FIG. 1, the first signal line group 31 is coupled to the first output terminal OT1 and the second signal line group 32 is coupled to the second output terminal OT2, it will be readily appreciated by those skilled in the art that the first signal line group 31 may also be coupled to the second output terminal OT2 and the second signal line group 32 may also be coupled to the first output terminal OT1.

It will be readily appreciated by those skilled in the art that any embodiment of the present disclosure about the demultiplexer circuit may also be applied to the signal line circuit described above.

The output circuit according to an embodiment of the present disclosure may include a demultiplexer circuit 10, a first signal line group 31, a second signal line group 32, a first signal line Data1, and a second signal line Data2. The demultiplexer circuit 10 is coupled to the first signal line Data1 and the second signal line Data2, outputs the first signal from the first signal line Data1 and the second signal from the second signal line Data2 to the first signal line group 31, and outputs the first signal from the first signal line Data1 and the second signal from the second signal line Data2 to the second signal line group 32.

It is to be noted that the demultiplexer circuit of the output circuit may employ any embodiment of the present disclosure about the demultiplexer circuit.

In the above embodiments, through at least one input terminal of the demultiplexer circuit receiving at least one signal and at least one output terminal of the demultiplexer circuit outputting a plurality of signals, the signal input lines and the input terminals can be effectively reduced, conducive to saving the layout space.

In addition, through the time division driving of the demultiplexer circuit, using at least one signal line to drive a plurality of signal line groups of the display device in time division is implemented, and point inversion or column (row) inversion may also be implemented.

FIG. 1 shows a structure of an output circuit according to an exemplary embodiment of the present disclosure. As shown in FIG. 1, the output circuit according to the present disclosure may include a first signal line Data1, a second signal line Data2, a first signal line group 31, a second signal line group 32, and at least one set of demultiplexer circuits 10.

In particular, the demultiplexer circuit 10 includes at least one first input terminal IT1, at least one second input terminal IT2, at least one first output terminal OT1, and at least one second output terminal OT2. Wherein the first input terminal IT1 is coupled to the first signal line Data1 to receive the first signal, the second input terminal IT2 is coupled to the second signal line Data2 to receive the second signal, the first output terminal OT1 outputs the first signal and the second signal, and the second output terminal OT2 outputs the first signal and the second signal.

In particular, the demultiplexer circuit 10 may further include a signal selection group 41 and at least one selection switch group 20, and each selection switch group 20 at least includes a first selection switch subgroup 21 and a second selection switch subgroup 22. Wherein at least one terminal of the first selection switch subgroup 21 is coupled to the first input terminal IT1, at least one terminal of the second selection switch subgroup 22 is coupled to the second input terminal IT2, at least one terminal of the first selection switch subgroup 21 is coupled to the first output terminal OT1, and at least one terminal of the second selection switch subgroup 22 is coupled to the second output terminal OT2.

As shown in FIG. 1, the signal line circuit according to the present disclosure may include only the demultiplexer circuit 10, the first signal line group 31, and the second signal line group 32. Wherein the first signal line group 31 receives the first signal and the second signal from the demultiplexer circuit 10, and the second signal line group 32 receives the first signal and the second signal from the demultiplexer circuit 10.

In another embodiment, at least one terminal of the first selection switch subgroup 21 is coupled to the first input terminal IT1, at least one terminal of the first selection switch subgroup 21 is coupled to the second input terminal IT2, and at least one terminal of the second selection switch subgroup 22 is coupled to the first input terminal IT1, and at least one terminal of the second selection switch subgroup 22 is coupled to the second input terminal IT2.

In other embodiments, at least one terminal of the first selection switch subgroup 21 is coupled to the first output terminal OT1, at least one terminal of the first selection switch subgroup 21 is coupled to the second output terminal OT2, and at least one terminal of the second selection switch subgroup 22 is coupled to the first output terminal OT1, and at least one terminal of the second selection switch subgroup 22 is coupled to the second output terminal OT2.

It should be noted that the first signal line group 31 may include k adjacent data lines on the array substrate, the second signal line group 32 may include n data lines on the array substrate adjacent to the first signal line group, and K corresponds to the number of signal selection lines in the signal selection group 41. If there is no opposite definite indication, k and n are natural numbers greater than or equal to two, and k and n may be the same natural number and may be different natural numbers.

The demultiplexer circuit, the signal line circuit, and the corresponding output circuit of the present disclosure are further described below with reference to FIGS. 2-5, by example of taking the selection transistor as an NMOS field effect transistor.

In the following description, the signal selection group 41 includes k terminals and k corresponding signal selection lines. The k selection transistors of the selection switch subgroup 21 correspond to the first output terminal OT1 of the demultiplexer circuit 10, the first output terminal OT1 has k output ports. The n selection transistors of the selection switch subgroup 22 correspond to the second output terminal OT2 of the demultiplexer circuit 10, and the second output terminal OT2 has n output ports.

Figure 2:
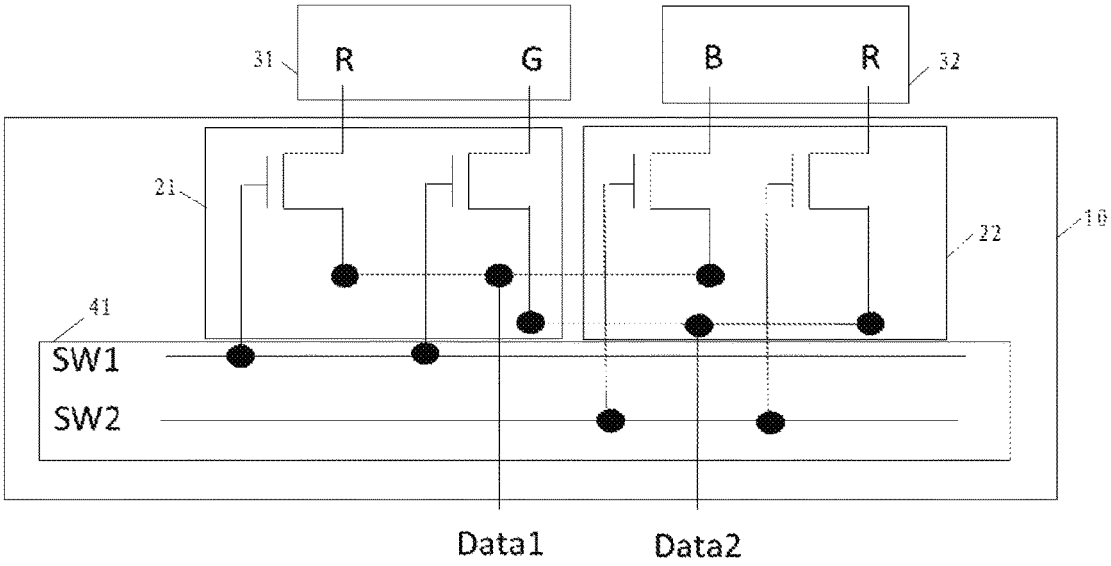
FIG. 2 is a 1:2 demultiplexer circuit according to an exemplary embodiment of the present disclosure.

FIG. 2 is a 1:2 demultiplexer circuit according to an exemplary embodiment of the present disclosure, that is, corresponding to a 1:2 demultiplexer circuit 10 with k=2, n=2. At this time, k is an even number.

By example of one pixel including RGB (Red, Green, Blue) subpixels, a plurality of data lines of the array substrate are sequentially coupled to the RGB lines of the respective pixels. The first signal line group 31 includes the R line and the G line in the first pixel, the second signal line group 32 includes the B line in the first pixel and the R line in the second pixel, while the first selection switch subgroup 21 includes the preceding two NMOS field effect transistors, the second selection switch subgroup 22 includes the following two NMOS field effect transistors. At this time, the signal selection group 41 includes two signal selection lines SW1 and SW2, and the selection switch group 20 (including the first selection switch subgroup 21 and the second selection switch subgroup 22) includes k+n (i.e., 4) NMOS field effect transistors.

As shown in FIG. 2, the second electrodes of the four NMOS field effect transistors in the selection switch group 20 are alternately coupled to the first signal line Data1 and the second signal line Data2 through the first input terminal IT1 or the second input terminal IT2. That is, the second electrodes of the first and third NMOS field effect transistors are coupled to the first signal line Data1, and the second electrodes of the second and fourth NMOS field effect transistors are coupled to the second signal line Data2, wherein the second electrode of the NMOS field effect transistor is the source electrode of the NMOS field effect transistor. The first electrodes of the two NMOS field effect transistors in the first selection switch subgroup 21 (i.e., the first and second NMOS field effect transistors) are respectively coupled to the two data lines in the first signal line group 31 (i.e., the R line and the G line in the first pixel) one-to-one, the first electrodes of the two NMOS field effect transistors in the second selection switch subgroup 22 (i.e., the third and fourth NMOS field effect transistors) are respectively coupled to the two data lines in the second signal line group 32 (i.e., the B line in the first pixel and the R line in the second pixel) one-to-one, wherein the first electrode of the NMOS field effect transistor is the drain electrode of the NMOS field effect transistor.

Accordingly, the gate electrodes of the two adjacent NMOS field effect transistors in the selection switch group 20 are commonly coupled to one of the signal selection lines SW1 and SW2 in the signal selection group 41. For example, the gate electrodes of the first and second NMOS field effect transistors are commonly coupled to the signal selection line SW1 and the gate electrodes of the third and fourth NMOS field effect transistors are commonly coupled to the signal selection line SW2. Thus, a 1:2 demultiplexer that implements column inversion is formed. It is worth noting that, according to the actual needs, a 1:2 demultiplexer that implements point inversion may also be implemented.

In the present embodiment, k=n=2, wherein the signal selection group 41 includes two terminals and two corresponding signal selection lines SW1, SW2. The two NMOS field effect transistors in the first selection switch subgroup 21 respectively correspond to two output ports of the first output terminal OT1 of the demultiplexer circuit 10. The two output ports of the first output terminal OT1 are respectively coupled to two data lines of the first signal line group 31. The two NMOS field effect transistors in the second selection switch subgroup 22 respectively correspond to the two output ports of the second output terminal OT2 of the demultiplexer circuit 10. The two output ports of the second output terminal OT2 are respectively coupled to two data lines of the second signal line group 2. The relationships between the other output terminals and other signal line groups are similar.

The operation flow of the 1:2 demultiplexer circuit shown in FIG. 2 is as follows: when the signal on the signal selection line SW1 turns on the NMOS field effect transistors, the first and second signal lines Data1 and Data2 provide a data signal to the R line and the G line in the first pixel through the first and second NMOS field effect transistors, when the signal on the signal selection line SW2 turns on the NMOS field effect transistors, the first and second signal lines Data1 and Data2 provide a data signal to the B line in the first pixel and the R line in the second pixel through the third and fourth NMOS field effect transistors.

If the signals of the first and second signal lines Data1 and Data2 remain unchanged in polarity at some stage of the time-division driving, but both are opposite in polarity (for example, the first signal line Data1 remains a positive signal in the first stage of the time-division driving, and the second signal line Data2 remains a negative signal in the first stage of the time-division driving, or the first signal line Data1 remains a negative signal in the first stage of the time-division driving, and the second signal line Data2 remains a positive signal in the first stage of the time-division driving), it facilitates to implement the point inversion or column inversion of the array substrate with low power consumption.

It should be appreciated that the demultiplexer circuit 10 in the present embodiment is further divided with reference to FIG. 1, and that the demultiplexer circuit 10 in the subsequent embodiments may be similarly divided with reference to FIGS. 1 and 2. Herein no more description will be given.

It should be appreciated that in this embodiment the structure and operation flow of the demultiplexer circuit 10 are described, and likewise, the present embodiment is applicable to the signal line circuit and the output circuit. The difference is that the signal line circuit further includes a first signal line group 31 and a second signal line group 32 and the output circuit further includes a first signal line data1, a second signal line data2, a first signal line group 31, and a second signal line group 32, which will not be repeated herein.

Figure 3:
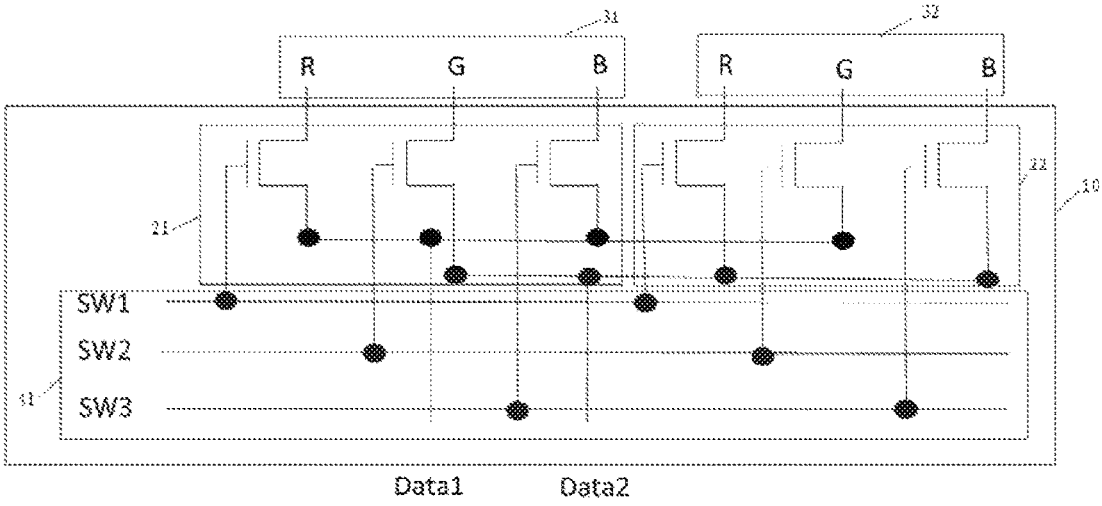
FIG. 3 is a 1:3 demultiplexer circuit according to an exemplary embodiment of the present disclosure.

FIG. 3 shows a 1:3 demultiplexer circuit according to an exemplary embodiment of the present disclosure, that is, corresponding to a 1:3 demultiplexer circuit 10 with k=3, n=3. At this time, k is an odd number.

By example of one pixel including RGB (Red, Green, Blue) subpixels, a plurality of data lines of the array substrate are sequentially coupled to the RGB lines of the respective pixels. The first signal line group 31 includes an R line, a G line, and a B line in the first pixel, and the second signal line group 32 includes an R line, a G line, and a B line in the second pixel. The first selection switch subgroup 21 includes the preceding three NMOS field effect transistors, and the second selection switch subgroup 22 includes the following three NMOS field effect transistors. At this time, the signal selection group 41 includes three signal selection lines SW1, SW2 and SW3, and the selection switch group 20 (including the first selection switch subgroup 21 and the second selection switch subgroup 22) includes k+n (i.e., 6) NMOS field effect transistors.

As shown in FIG. 3, the second electrodes of the six NMOS field effect transistors in the selection switch group 20 are alternately coupled to the first signal line Data1 and the second signal line Data2 through the first input terminal IT1 or the second input terminal IT2, that is, the second electrodes of the first, third and fifth NMOS field effect transistors are coupled to the first signal line Data1 and the second electrodes of the second, fourth and sixth NMOS field effect transistors are coupled to the second signal line Data2, wherein the second electrode of the NMOS field effect transistor is the source electrode of the NMOS field effect transistor. The first electrodes of the three NMOS field effect transistors in the first selection switch subgroup 21 (i.e., the first, second, and third NMOS field effect transistors) are respectively coupled to the three data lines in the first signal line group 31 (i.e., the R line, the G line, and the B line in the first pixel) one-to-one, and the first electrodes of the three NMOS field effect transistors in the second selection switch subgroup 22 (i.e., the fourth, fifth, and sixth NMOS field effect transistors) are respectively coupled to the three data lines in the second signal line group 32 (i.e., the R line, the G line, and the B line in the second pixel) one-to-one, wherein the first electrode of the NMOS field effect transistor is the drain electrode of the NMOS field effect transistor.

Accordingly, the gate electrodes of the three NMOS field effect transistors in the first and second selection switch subgroups 21 and 22 are respectively coupled to the three signal selection lines SW1-SW3 in the signal selection group 41 one-to-one. For example, the gate electrodes of the first, second, and third NMOS field effect transistors are respectively coupled to the signal selection lines SW1, SW2 and SW3. Similarly, the gate electrodes of the fourth, fifth, and sixth NMOS field effect transistors are respectively coupled to the signal selection lines SW1, SW2 and SW3. Thus, a 1:3 demultiplexer that implements column inversion is formed. It is worth noting that, according to the actual needs, 1:3 demultiplexer that implements point inversion may also be implemented.

In the present embodiment, k=n=3, wherein the signal selection group 41 includes three terminals and three corresponding signal selection lines SW1, SW2 and SW3. The three NMOS field effect transistors in the first selection switch subgroup 21 respectively correspond to the three output ports of the first output terminal OT1 of the demultiplexer circuit 10 one-to-one, the three output ports of the first output terminal OT1 are respectively coupled to the three data lines of the first signal line group 31. The three NMOS field effect transistors in the second selection switch subgroup 22 correspond to the three output ports of the second output terminal OT2 of the demultiplexer circuit 10, the three output ports of the second output terminal OT2 are coupled to the three data lines of the second signal line group 32, and the relationships between other output terminals and other signal line groups are similar.

The operation flow of the 1:3 demultiplexer circuit shown in FIG. 3 is as follows: when the signal on the signal selection line SW1 turns on the NMOS field effect transistors, the first and second signal lines Data1 and Data2 provide a data signal to the R line in the first pixel and the R line in the second pixel through the first and fourth NMOS field effect transistors, when the signal on the signal selection line SW2 turns on the NMOS field effect transistors, the first and second signal lines Data1 and Data2 provide a data signal to the G line in the first pixel and the G line in the second pixel through the second and fifth NMOS field effect transistors, respectively, when the signal on the signal selection line SW3 turns on the NMOS field effect transistors, the first and second signal lines Data1 and Data2 provide a data signal to the B line in the first pixel and the B line in the second pixel through the third and sixth NMOS field effect transistors, respectively.

If the signals of the first and second signal lines Data1 and Data2 remain unchanged in polarity at some stage of the time-division driving, but both are opposite in polarity (for example, the first signal line Data1 remains a positive signal in the first stage of the time-division driving, and the second signal line Data2 remains a negative signal in the first stage of the time-division driving, or the first signal line Data1 remains a negative signal in the first stage of the time-division driving, and the second signal line Data2 remains a positive signal in the first stage of the time-division driving), it facilitates implementing the point inversion or column inversion of the array substrate with low power consumption.

Figure 4:
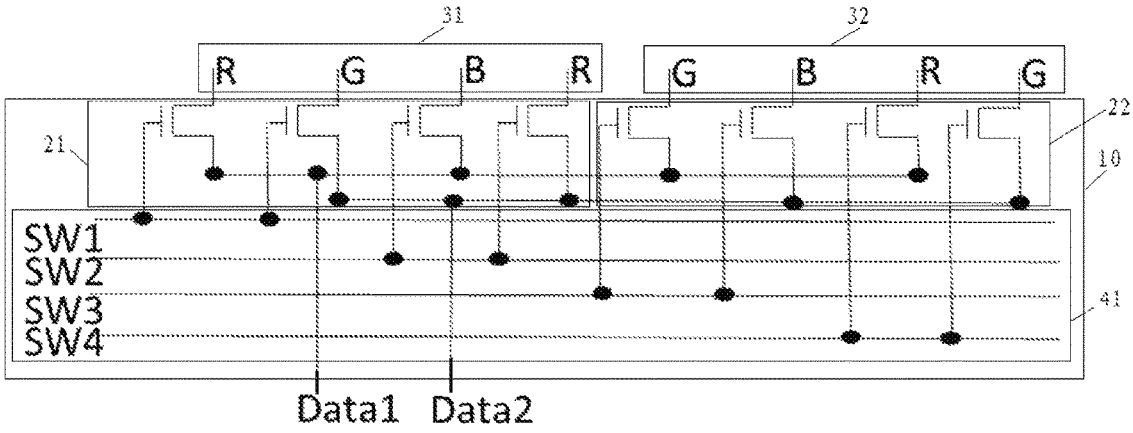
FIG. 4 is a 1:4 demultiplexer circuit according to an exemplary embodiment of the present disclosure.

FIG. 4 is a 1:4 demultiplexer circuit according to an exemplary embodiment of the present disclosure, that is, corresponding to a 1:4 demultiplexer circuit 10 with k=4, n=4. At this time, k is an even number.

By example of one pixel including RGB (Red, Green, Blue) subpixels, a plurality of data lines of the array substrate are sequentially coupled to the RGB lines of the respective pixels. The first signal line group 31 includes an R line, a G line, and a B line in the first pixel and an R line in the second pixel, the second signal line group 32 includes a G line and a B line in the second pixel and an R line and a G line in the third pixel, the first selection switch subgroup 21 includes the preceding four NMOS field effect transistors, and the second selection switch subgroup 22 includes the following four NMOS field effect transistors. At this time, the signal selection group 41 includes four signal selection lines SW1-SW4, and the selection switch group 20 (including the first selection switch subgroup 21 and the second selection switch subgroup 22) includes k+n (i.e., 8) NMOS field effect transistors.

As shown in FIG. 4, the second electrodes of the eight NMOS field effect transistors in the selection switch group 20 are alternately coupled to the first signal line Data1 and the second signal line Data2 through the first input terminal IT1 or the second input terminal IT2, that is, the second electrodes of the first, third, fifth and seventh NMOS field effect transistors are coupled to the first signal line Data1 and the second electrodes of the second, fourth, sixth and eighth NMOS field effect transistors are coupled to the second signal line Data2, wherein the second electrode of the NMOS field effect transistor is the source electrode of the NMOS field effect transistor. The first electrodes of the four NMOS field effect transistors in the first selection switch subgroup 21 (i.e., the first to fourth NMOS field effect transistors) are respectively coupled to the four data lines in the first signal line group 31 (i.e., the R line, the G line, and the B line in the first pixel and the R line in the second pixel) one-to-one, and the first electrodes of the four NMOS field effect transistors in the second selection switch subgroup 22 (i.e., the fifth to eighth NMOS field effect transistors) are respectively coupled to the four data lines in the second signal line group 32 (i.e., the G line, and the B line in the second pixel and the R line and the G line in the third pixel) one-to-one, wherein the first electrode of the NMOS field effect transistor is the drain electrode of the NMOS field effect transistor.

Accordingly, the gate electrodes of the two adjacent NMOS field effect transistors in the selection switch group 20 are commonly coupled to one of the signal selection lines SW1 and SW2 in the signal selection group 41. For example, the gate electrodes of the first and second NMOS field effect transistors are commonly coupled to the signal selection line SW1, the gate electrodes of the third and fourth NMOS field effect transistors are commonly coupled to the signal selection line SW2, the gate electrodes of the fifth and sixth NMOS field effect transistors are commonly coupled to the signal selection line SW3, the gate electrodes of the seventh and eighth NMOS field effect transistors are commonly coupled to the signal selection line SW4. Thus, a 1:4 demultiplexer that implements column inversion is formed. It is worth noting that, according to the actual needs, 1:4 demultiplexer that implements point inversion may also be implemented.

In the present embodiment, k=4, n=4, wherein the signal selection group 41 includes four terminals and four corresponding signal selection lines SW1-SW4. The four NMOS field effect transistors in the first selection switch subgroup 21 respectively correspond to the four output ports of the first output terminal OT1 of the demultiplexer circuit 10 one-to-one, the four output ports of the first output terminal OT1 are respectively coupled to the four data lines of the first signal line group 31. The four NMOS field effect transistors in the second selection switch subgroup 22 correspond to the four output ports of the second output terminal OT2 of the demultiplexer circuit 10, the four output ports of the second output terminal OT2 are respectively coupled to the four data lines of the second signal line group 32. The relationships between other output terminals and other signal line groups are similar.

The operation flow of the 1:4 demultiplexer circuit shown in FIG. 4 is as follows: when the signal on the signal selection line SW1 turns on the NMOS field effect transistors, the first and second signal lines Data1 and Data2 provide a data signal to the R line and the G line in the first pixel through the first and second NMOS field effect transistors, when the signal on the signal selection line SW2 turns on the NMOS field effect transistors, the first and second signal lines Data1 and Data2 provide a data signal to the B line in the first pixel and the R line in the second pixel through the third and fourth NMOS field effect transistors, respectively, when the signal on the signal selection line SW3 turns on the NMOS field effect transistors, the first and second signal lines Data1 and Data2 provide a data signal to the G line and the B line in the second pixel through the fifth and sixth NMOS field effect transistors, respectively; when the signal on the signal selection line SW4 turns on the NMOS field effect transistors, the first and second signal lines Data1 and Data2 provide a data signal to the R line and the G line in the third pixel through the seventh and eighth NMOS field effect transistors, respectively.

If the signals of the first and second signal lines Data1 and Data2 remain unchanged in polarity at some stage of the time-division driving, but both are opposite in polarity (for example, the first signal line Data1 remains a positive signal in the first stage of the time-division driving, and the second signal line Data2 remains a negative signal in the first stage of the time-division driving, or the first signal line Data1 remains a negative signal in the first stage of the time-division driving, and the second signal line Data2 remains a positive signal in the first stage of the time-division driving), it facilitates implementing the point inversion or column inversion of the array substrate with low power consumption.

Figure 5:
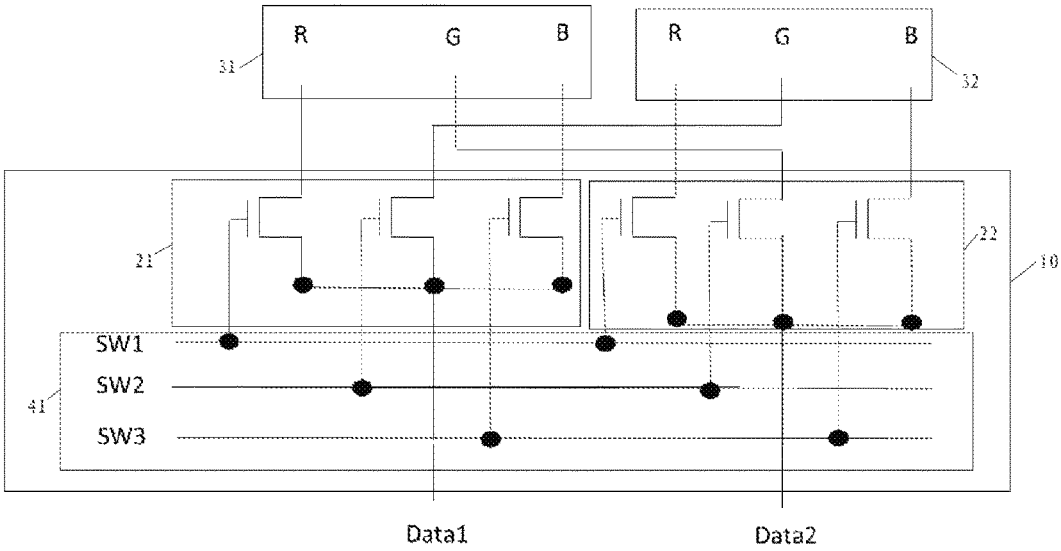
FIG. 5 is a 1:3 demultiplexer circuit according to another exemplary embodiment of the present disclosure.

FIG. 5 is a 1:3 demultiplexer circuit according to another exemplary embodiment of the present disclosure, that is, corresponding to a 1:3 demultiplexer circuit 10 with k=3, n=3. At this time, k is an odd number.

By example of one pixel including RGB (Red, Green, Blue) subpixels, a plurality of data lines of the array substrate are sequentially coupled to the RGB lines of the respective pixels. The first signal line group 31 includes an R line, a G line, and a B line in the first pixel, and the second signal line group 32 includes an R line, a G line and a B line in the second pixel. The first selection switch subgroup 21 includes the preceding three NMOS field effect transistors, and the second selection switch subgroup 22 includes the following three NMOS field effect transistors. At this time, the signal selection group 41 includes three signal selection lines SW1, SW2, and SW3, and the selection switch group 20 (including the first selection switch subgroup 21 and the second selection switch subgroup 22) includes k+n (i.e., 6) NMOS field effect transistors.

As shown in FIG. 5, unlike the above-described embodiments 1-3 (i.e., there is no cross connection between the first selection switch subgroup 21 and the second signal line group 32, and between the second selection switch subgroup 22 and the first signal line group 31, in the embodiments 1-3. However, there are cross connections between the first selection switch subgroup 21 and the second signal line group 32, and between the second selection switch subgroup 22 and the first signal line group 31, in the embodiment 4), the second electrodes of the three NMOS field effect transistors in the first selection switch subgroup are commonly coupled to the first signal line Data1, and the second electrodes of the three NMOS field effect transistors in the second selection switch subgroup are commonly coupled to the second signal line Data2, wherein the second electrode of the NMOS field effect transistor is the source electrode of the NMOS field effect transistor. At this time, the first electrodes of the three NMOS field effect transistors in the first selection switch subgroup (i.e., the first, third, and second NMOS field effect transistors) are respectively coupled to the two data lines in the first signal line group (i.e., the R line and the B line in the first pixel) and one data line in the second signal line group (i.e., the G line in the second pixel) one-to-one. The first electrodes of the three NMOS field effect transistors in the second selection switch subgroup (i.e., the fourth, sixth, and fifth NMOS field effect transistors) are respectively coupled to the two data lines in the second signal line group (i.e., the R line and the B line in the second pixel) and one data line in the first signal line group (i.e., the G line in the first pixel) one-to-one, wherein the first electrode of the NMOS field effect transistor is the drain electrode of the NMOS field effect transistor.

As shown in FIG. 5, the gate electrodes of the three NMOS field effect transistors in the first and second selection switch subgroups are respectively coupled to the three signal selection lines SW1-SW3 in the signal selection group one-to-one. For example, the gate electrodes of the first, second and third NMOS field effect transistors are coupled to SW1, SW2, and SW3, respectively. Similarly, the gate electrodes of the fourth, fifth and sixth NMOS field effect transistors are coupled to SW1, SW2, and SW3, respectively. Thus, a 1:3 demultiplexer that implements column inversion and point inversion is formed. It is worth noting that, according to the actual needs, 1:3 demultiplexer that implements point inversion may also be implemented.

The operation flow of the 1:3 demultiplexer circuit shown in FIG. 5 is as follows: when the signal on the signal selection line SW1 turns on the NMOS field effect transistors, the first and second signal lines Data1 and Data2 provide a data signal to the R line in the first pixel and the R line in the second pixel through the first and fourth NMOS field effect transistors, when the signal on the signal selection line SW2 turns on the NMOS field effect transistors, the first and second signal lines Data1 and Data2 provide a data signal to the G line in the second pixel and the G line in the first pixel through the second and fifth NMOS field effect transistors, respectively, when the signal on the signal selection line SW3 turns on the NMOS field effect transistors, the first and second signal lines Data1 and Data2 provide a data signal to the B line in the first pixel and the B line in the second pixel through the third and sixth NMOS field effect transistors, respectively.

If the signals of the first and second signal lines Data1 and Data2 remain unchanged in polarity at some stage of the time-division driving, but both are opposite in polarity (for example, the first signal line Data1 remains a positive signal in the first stage of the time-division driving, and the second signal line Data2 remains a negative signal in the first stage of the time-division driving, or the first signal line Data1 remains a negative signal in the first stage of the time-division driving, and the second signal line Data2 remains a positive signal in the first stage of the time-division driving), it facilitates implementing the point inversion or column inversion of the array substrate with low power consumption.

It is not difficultly understood by those skilled in the art that the selection transistors in the embodiments described herein may also use PMOS field effect transistors based on the technical implications given by the selection transistors using NMOS field effect transistors.

It should be appreciated that the above-described embodiments are also applicable to pixels of other color combinations. For example: one pixel includes red color R, blue color B, green color G, yellow color Y, or red color R, blue color B, green color G, white color W and so on.

It should be appreciated that the above embodiments take the R line of the pixel as the starting point of the signal line group, and of course also may take other G line or B line as the starting point of the signal line group.

It should be appreciated that the first signal line and the first signal, the second signal line and the second signal in the embodiments of the present disclosure are described by example of the data signal data, and may of course be applied to other signals such as a gate scan signal Gate, a common voltage signal Com, and so on, so that the layout space can be saved as well. In addition, when the first signal and the second signal are gate scan signals Gate, it is also possible to realize row inversion or the like.

It should be appreciated that the "first", "second" and similar words used in the embodiments of the present disclosure do not imply a limitation on any order, quantity or importance, but are merely used to distinguish between different constituent parts.

For example, the first signal line and the first signal, the second signal line and the second signal in the embodiments of the present disclosure are only for distinguishing the signals from the first signal line and the second signal line and do not represent that the first signal and the second signal do not change at all, nor represent that the first signal or the second signal is limited to one signal. For example, in the first stage of the time-division driving, the first signal line Data1 remains a positive signal, but R1, G1, B1 signals (i.e., the R, G, B signals corresponding to the first pixel) are inputted in time division, while in the first stage of the time-division driving, the second signal line Data2 remains a negative signal, but the R2, G2, B2 signals (i.e., the R, G, B signals corresponding to the second pixel) are inputted in time division. Or, in the first stage of the time-division driving, the first signal line Data1 remains a negative signal, but the R1, G1, B1 signals are inputted in time division, while in the first stage of the time-division driving, the second signal line Data2 remains a positive signal, but the R2, G2, B2 signals are inputted in time division. In the second stage of the time-division driving, the first signal line Data1 remains a negative signal, but the R1, G1, B1 signals are inputted in time-division, and in the second stage of the time-division driving, the second signal line Data2 remains a positive signal but R2, G2, B2 signals are inputted in time division. Or, in the second stage of the time-division driving, the first signal line Data1 remains a positive signal, but the R1, G1, B1 signals are inputted in time-division, while in the second stage of the time-division driving, the second signal lines Data2 remains a negative signal, but the R2, G2, B2 signals are inputted in time division.

The embodiment of the present disclosure further provides a display device which may include a demultiplexer circuit, a signal line circuit, and an output circuit of any one of the above-described embodiments or combinations thereof.

It should be appreciated that the above-described demultiplexer circuit, signal line circuit, and output circuit and any combination thereof according to the embodiments of the present disclosure can be applied to a display device and the corresponding display device also should fall within the scope of protection sought for by the present disclosure.

In the specific implementation, the display device provided by the present disclosure may be device having a display function such as a mobile phone, a television set, a desktop computer, a PAD, a palmtop computer, or the like.

The forgoing is merely about specific embodiments of the present disclosure, but the scope of protection sought for by the present disclosure is not limited thereto, and any change or substitution easily conceivable to those skilled in the art within the technical scope revealed by the present disclosure shall fall within the scope of protection sought for by the present disclosure. Therefore, the scope of protection sought for by the present disclosure shall be based on the scope of protection of the accompanying claims.

What is claimed is:

1. A demultiplexer circuit comprising:

at least one first input terminal configured to receive a first signal;

at least one second input terminal configured to receive a second signal;

at least one first output terminal configured to output the first signal and the second signal;

at least one second output terminal configured to output the first signal and the second signal, and at least one selection switch group, wherein the selection switch group comprises a first selection switch subgroup and a second selection switch subgroup, wherein at least one terminal of the first selection switch subgroup is coupled to the first input terminal, wherein at least one terminal of the first selection switch subgroup is coupled to the second input terminal, wherein at least one terminal of the second selection switch subgroup is coupled to the first input terminal, and wherein at least one terminal of the second selection switch subgroup is coupled to the second input terminal;

wherein the demultiplexer circuit further comprises a signal selection group which comprises a plurality of output terminals, wherein at least one output terminal of the signal selection group is coupled to the first selection switch subgroup, and wherein at least one output terminal of the signal selection group is coupled to the second selection switch subgroup.

2. The demultiplexer circuit according to claim 1, wherein at least one terminal of the first selection switch subgroup is coupled to the first output terminal, and wherein at least one terminal of the second selection switch subgroup is coupled to the second output terminal.

3. The demultiplexer circuit according to claim 1, wherein at least one terminal of the first selection switch subgroup is coupled to the first output terminal, wherein at least one terminal of the first selection switch subgroup is coupled to the second output terminal, wherein at least one terminal of the second selection switch subgroup is coupled to the first output terminal, and wherein at least one terminal of the second selection switch subgroup is coupled to the second output terminal.

4. The demultiplexer circuit according to claim 1, wherein the first selection switch subgroup and the second selection switch subgroup each comprise at least two selection transistors, and wherein a gate electrode of each selection transistor is coupled to at least one output terminal of the signal selection group.

5. The demultiplexer circuit according to claim 4, wherein the signal selection group comprises k signal selection lines corresponding to k output terminals of the signal selection group, wherein one of i) the gate electrodes of at least two adjacent selection transistors in one of the first selection switch subgroup and the second selection switch subgroup are commonly coupled to one of the k signal selection lines, and ii) the gate electrodes of the selection transistors in one of the first selection switch subgroup and the second selection switch subgroup are respectively coupled to the signal selection lines one-to-one, and wherein k is a natural number greater than or equal to two.

6. The demultiplexer circuit according to claim 4, wherein the signal selection group comprises k signal selection lines corresponding to k output terminals of the signal selection group, wherein the first selection switch subgroup comprises k selection transistors, wherein the second selection switch subgroup comprises n selection transistors, wherein second electrodes of at least a part of the selection transistors in the first selection switch subgroup are coupled to at least one of the first input terminal and the second input terminal, wherein second electrodes of at least a part of the selection transistors in the second selection switch subgroup are coupled to at least one of the first input terminal and the second input terminal, and wherein k and n are natural numbers greater than or equal to two.

7. The demultiplexer circuit according to claim 5, wherein first electrodes of at least a part of the selection transistors in the first selection switch subgroup are coupled to the second output terminal, wherein first electrodes of at least a part of the selection transistors in the second selection switch subgroup are coupled to the first output terminal, wherein gate electrodes of the selection transistors in the first selection switch subgroup are respectively coupled to the corresponding signal selection lines, and wherein gate electrodes of the selection transistors in the second selection switch subgroup are respectively coupled to the corresponding signal selection lines.

8. The demultiplexer circuit according to claim 4, wherein second electrodes of a part of the selection transistors in the first selection switch subgroup are coupled to the first input terminal, wherein second electrodes of a part of the selection transistors in the first selection switch subgroup are coupled to the second input terminal, wherein second electrodes of a part of the selection transistors in the second selection switch subgroup are coupled to the first input terminal, and wherein second electrodes of a part of the selection transistors in the second selection switch subgroup are coupled to the second input terminal.

9. The demultiplexer circuit according to claim 6, wherein the first output terminal comprises k output ports, wherein the second output terminal comprises n output ports, wherein first electrodes of the k selection transistors in the first selection switch subgroup are coupled to the k output ports of the first output terminal one-to-one, wherein first electrodes of the n selection transistors in the second selection switch subgroup are coupled to the n output ports of the second output terminal one-to-one, wherein second electrodes of the selection transistors in the selection switch group are alternately coupled to the first input terminal and the second input terminal, wherein gate electrodes of the selection transistors in the first selection switch subgroup and the second selection switch subgroup are respectively coupled to different signal selection lines one-to-one, and wherein k and n are odd numbers.

10. The demultiplexer circuit according to claim 6, wherein the first output terminal comprises k output ports, wherein the second output terminal comprises n output ports, wherein first electrodes of the k selection transistors in the first selection switch subgroup are coupled to the k output ports of the first output terminal one-to-one, wherein first electrodes of the n selection transistors in the second selection switch subgroup are coupled to the n output ports of the second output terminal one-to-one, wherein second electrodes of the selection transistors in the first selection switch subgroup are alternately coupled to the first input terminal and the second input terminal, wherein second electrodes of the selection transistors in the second selection switch subgroup are alternately coupled to the first input terminal and the second input terminal, wherein gate electrodes of at least two adjacent selection transistors in one of the first selection switch subgroup and the second selection switch subgroup are commonly coupled to one of the k signal selection lines, and wherein k and n are even numbers.

11. The demultiplexer circuit according to claim 6, wherein the first output terminal comprises k output ports, wherein the second output terminal comprises ii output ports, wherein a first electrode of at least one selection transistor in the first selection switch subgroup is coupled to one output port of the second output terminal, and wherein a first electrode of at least one selection transistor in the second selection switch subgroup is coupled to one output port of the first output terminal.

12. The demultiplexer circuit according to claim 5, wherein i) the selection transistor is an NMOS field effect transistor, a first electrode of the selection transistor is the drain electrode of the NMOS field effect transistor, and a second electrode of the selection transistor is the source electrode of the NMOS field effect transistor, or ii) the selection transistor is a PMOS field effect transistor, a first electrode of the selection transistor is the source electrode of the PMOS field effect transistor, and the second electrode of the selection transistor is the drain electrode of the PMOS field effect transistor.

13. The demultiplexer circuit according to claim 1, wherein the first signal and the second signal are one of a data signal, a gate scan signal, and a common voltage signal.

14. The demultiplexer circuit according to claim 1, wherein the voltages of the first signal and the second signal are opposite in polarity.

15. A signal line circuit comprising:

a demultiplexer circuit according to claim 1;

a first signal line group configured to receive a first signal and a second signal from the demultiplexer circuit; and a second signal line group configured to receive the first signal and the second signal from the demultiplexer circuit, wherein the demultiplexer circuit comprises:

at least one first input terminal configured to receive a first signal;

at least one second input terminal configured to receive a second signal;

at least one first output terminal configured to output the first signal and the second signal; and at least one second output terminal configured to output the first signal and the second signal, and wherein the first signal line group is coupled to the first output terminal, and the second signal line group is coupled to the second output terminal.

16. An output circuit comprising:

a demultiplexer circuit according to claim 1;

a first signal line group;

a second signal line group; and a first signal line and a second signal line, wherein the demultiplexer circuit is coupled to the first signal line and the second signal line, outputs a first signal from the first signal line and a second signal from the second signal line to the first signal line group, and outputs the first signal from the first signal line and the second signal from the second signal line to the second signal line group, and wherein the demultiplexer circuit comprises:

at least one first input terminal configured to receive a first signal;

at least one second input terminal configured to receive a second signal;

at least one first output terminal configured to output the first signal and the second signal; and at least one second output terminal configured to output the first signal and the second signal, and wherein the first signal line group is coupled to the first output terminal, and the second signal line group is coupled to the second output terminal.

17. A display device comprising the demultiplexer circuit according to claim 1.

* * * * *